US007690511B2

(12) United States Patent
Arnold et al.

(10) Patent No.: US 7,690,511 B2
(45) Date of Patent: Apr. 6, 2010

(54) CHILD RESISTANT BLISTER PACKAGING AND A METHOD OF REMOVING THE CONTENTS THEREFROM

(75) Inventors: William S. Arnold, New Hope, PA (US); Joseph M. Schaeffer, Langhorne, PA (US); William A. Callanan, Medford, NJ (US)

(73) Assignee: Permalith Plastics, Pennsauken, NJ (US)

( * ) Notice: Subject to any disclaimer, the term of this patent is extended or adjusted under 35 U.S.C. 154(b) by 85 days.

(21) Appl. No.: 11/856,824

(22) Filed: Sep. 18, 2007

(65) Prior Publication Data

US 2009/0071863 A1 Mar. 19, 2009

(51) Int. Cl.
*B65D 83/04* (2006.01)

(52) U.S. Cl. ..... 206/532; 206/531; 206/538

(58) Field of Classification Search ..... 206/528–540, 206/467, 468; 221/25

See application file for complete search history.

(56) References Cited

U.S. PATENT DOCUMENTS

| | | | | |
|---|---|---|---|---|
| 5,339,960 | A * | 8/1994 | Price | 206/531 |
| 6,675,972 | B2 * | 1/2004 | Patterson | 206/531 |
| 6,726,015 | B2 * | 4/2004 | Hulick | 206/531 |
| 6,896,138 | B2 * | 5/2005 | Rock et al. | 206/531 |
| 6,997,320 | B1 | 2/2006 | Kancsar et al. | |
| 2007/0056876 | A1 * | 3/2007 | Jones | 206/531 |

* cited by examiner

*Primary Examiner*—Ehud Gartenberg
*Assistant Examiner*—Andrew Perreault
(74) *Attorney, Agent, or Firm*—Paul & Paul

(57) ABSTRACT

A child resistant blister packaging having an upper cover sheet with at least one aperture, a bottom backing card with at least one scored exit port, and a blister laminate situated between the cover sheet and the backing card, the blister laminate includes at least one blister containing a cavity for receiving a pill and a foil layer adhered to the a bottom surface of the sheet. The blister protrudes through the aperture in the cover sheet and is arranged on a carrier tab that will not line up in registry with the scored exit port in the backing card. Upon the application of sufficient force, the blister can be moved to align the pill-receiving cavity with the scored exit port and the blister can be collapsed to force a medicament stored in the cavity through the foil layer and the scored exit port.

16 Claims, 4 Drawing Sheets

CHILD RESISTANT BLISTER PACKAGING AND A METHOD OF REMOVING THE CONTENTS THEREFROM

TECHNICAL FIELD OF THE INVENTION

The present invention relates to blister packaging designed to distribute products such as pharmaceutical drugs and the method of removing the contents of such packaging. More particularly, the present invention relates to blister packaging designed to distribute pharmaceutical drugs that provide difficult access for a child. The present invention is ideally suited for use with pharmaceutical drugs, but may be used to distribute any product that may be contained within blister packaging.

BACKGROUND OF THE INVENTION

Individual packages for medicaments are well know in the art and are typically provided as physician samples, dose prescriptions, over-the-counter pharmaceuticals, and the like as is well known in the trade. Such packaging usually contains medicaments which may be harmful, if ingested by a young child.

Accordingly, the problem associated with the use of such packages is the ease in which the packaging may be opened by small children as a result of insufficient resistance. Thus, there has been a need for a blister package, which would eliminate the problems associated with the prior packages discussed above.

SUMMARY OF THE INVENTION

It has been found that a blister packaging particularly suited for packaging at least one medicament can be constructed in accordance with the present invention. In addition, the blister packaging of the present invention is resistant to being opened by children by increasing the difficulty of opening, while still being easily opened by adults.

The present invention provides a child resistant blister packaging for containing at least one medicament or the like having an upper cover sheet with at least one aperture, a bottom backing card with at least, one scored exit port, and a blister laminate situated between the cover sheet and the backing card, the blister laminate including a blister sheet having at least one blister containing a cavity for receiving a pill and a layer adhered to the a bottom surface of the blister sheet. The blister protrudes through the aperture in the cover sheet and is arranged on a carrier lab that will not line up in registry with the scored exit port in the backing card unless a force is applied to the blister to sever a connection means holding the carrier tab in place. Upon separating the connections means, the blister can be moved to align the pill-receiving cavity with the scored exit port and the blister can be collapsed to force a medicament stored in the cavity through the bottom layer of the blister laminate and the scored exit port.

It is, therefore, an important object of the present invention to provide a package construction of the type described which is child resistant while still being easily opened by adults.

It is yet another object of the present invention to provide a method of removing the contents from a child resistant blister packaging that is easily performed by adults, but difficult to accomplish by children.

It is a further object of the present invention to provide a packaging having a rigid cover sheet and backing card, and a blister having a lateral protrusion to enable a user to properly grip the packaging when attempting to remove the contents of the blister.

It is a further object of the present invention to provide a packaging having an aperture in the cover sheet to guide a blister protruding through the aperture along an arcuate path, and a resilient deformation neck to provide spring-like resistance to the movement of the blister.

It is another object of the present invention to provide a packaging wherein the connections means holding the carrier tab in place is a short, thin strip of material formed from the blister laminate.

It is yet another object of the present invention to provide a packaging wherein an elevated rib is formed parallel and adjacent to an edge of the deformation gap to create a stop for the carrier tab.

It is a further object of the present invention to provide a package construction having the advantageous characteristics mentioned in the preceding paragraph, which is simpler in structure and more economical in manufacture, and staunch, durable and reliable to effectively protect the contents, resist unauthorized tampering, and otherwise accomplish its intended objects.

Other objects of the present invention will become apparent upon reading the following specification and referring to the accompanying drawings, which form a material part of this disclosure.

The invention accordingly comprises the features of construction, combinations of elements, and arrangements of parts, which will be exemplified in the construction, hereinafter described, and of which the scope will be indicated by the appended claims.

BRIEF DESCRIPTION OF THE DRAWINGS

The various features, objects, benefits, and advantages of the present invention will become more apparent upon reading the following detailed description of the preferred embodiments along with the appended claims in conjunction with the drawings, wherein like reference numerals identify corresponding components:

DETAILED DESCRIPTION OF THE INVENTION

The child resistant blister packaging of the present invention for containing at least one medicament or the like, includes an upper cover sheet having at least one aperture, a bottom backing card having at least one generally square-shaped scored exit port, and a blister laminate situated between the cover sheet and the backing card, the blister laminate includes a sheet with a top surface having at least one blister containing a cavity for receiving a pill and a foil layer adhered to the a bottom surface of the sheet. The blister containing the pill-receiving cavity protrudes through the aperture in the cover sheet and is arranged on a generally square-shaped carrier tab that will not align in registry with the scored exit port in the backing card unless a force is applied to the pill-receiving cavity to sever a connection means holding the carrier tab in place. The carrier tab is punched into the blister laminate along with a deformation neck and a deformation gap. Upon separating the connections means, the pill-receiving cavity can be moved to align with the scored exit port by moving the carrier tab across the deformation gap and the blister containing the pill-receiving cavity can be collapsed to force the medicament through the foil layer and the scored exit port.

Figure 1:
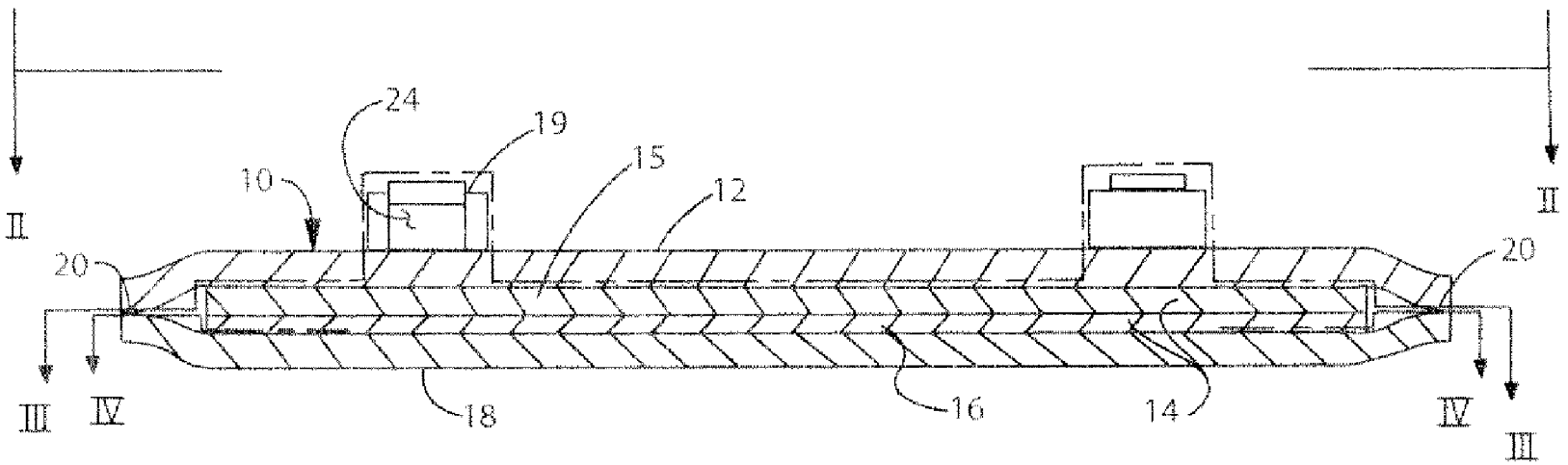
FIG. 1 is sectional view of the blister packaging of the present invention taken generally along line I-I in FIG.2.

Referring now more particularly to the drawings, and specifically to FIG. 1 thereof, there is illustrated therein a sectional view demonstrating the various layers of the present invention.

The top layer of the child resistant blister packaging 10 is a cover sheet 12 bonded to the bottom layer, which is a backing card 18, at adhesive lines or heat sealed lines 20. Any other method known to those skilled in the art that will secure the cover sheet 12 to the backing card 18 is also acceptable. The cover sheet 12 includes at least one aperture 22, and preferably a plurality of apertures 22. Both the cover sheet 12 and the backing card 18 are preferably made of a relatively rigid plastic material A blister laminate 14 is disposed between cover sheet 12 and the backing card 18. The blister laminate 14 is securely pressed between the two layers so that the blister laminate 14 remains stationary. Again, any method known to those skilled in the art that will secure the blister laminate 14 between the top and bottom layers of the blister packaging 10 is acceptable. The blister laminate 14 has at least two layers, a blister sheet 15 and a rupturable layer 16. The blister sheet 14 is formed from a flat, preferably clear plastic sheet of suitable transparent thermoplastic polymer which has been thermoformed or die-molded to form at least one blister 19 beneath which is a pill-receiving cavity 24 in the top surface of the blister sheet 15. The thermoplastic polymer must be weak enough so that the blister 19 containing the pill-receiving cavity 24 is collapsible if sufficient force is applied to the top of the blister 19 by manually pressing the same by a user's thumb or the like. The rupturable layer 16 is bonded to the bottom surface of the blister sheet 15. The blister 19 protrudes through the aperture 22 in the cover sheet 12. The rupturable layer 16 can comprise a plurality of layers, as long as the material is able to seal the pill-receiving cavity 24 and only rupture upon the application of force against the upper surface of the blister 19 by a user. The rupturable layer 16 is preferably thin, metallic foil. The pill-receiving cavity 24 can optionally include a lateral protrusion in the form of a lip 26. The lip 26 is slightly curved to accommodate the tip of a Singer or thumb. The curved surface area of the lip 26 evenly distributes the force exerted on the side of the blister 19 which is the first step in removing the contents of the packaging, as will be described in greater detail below.

Figures 2, 3, 4:
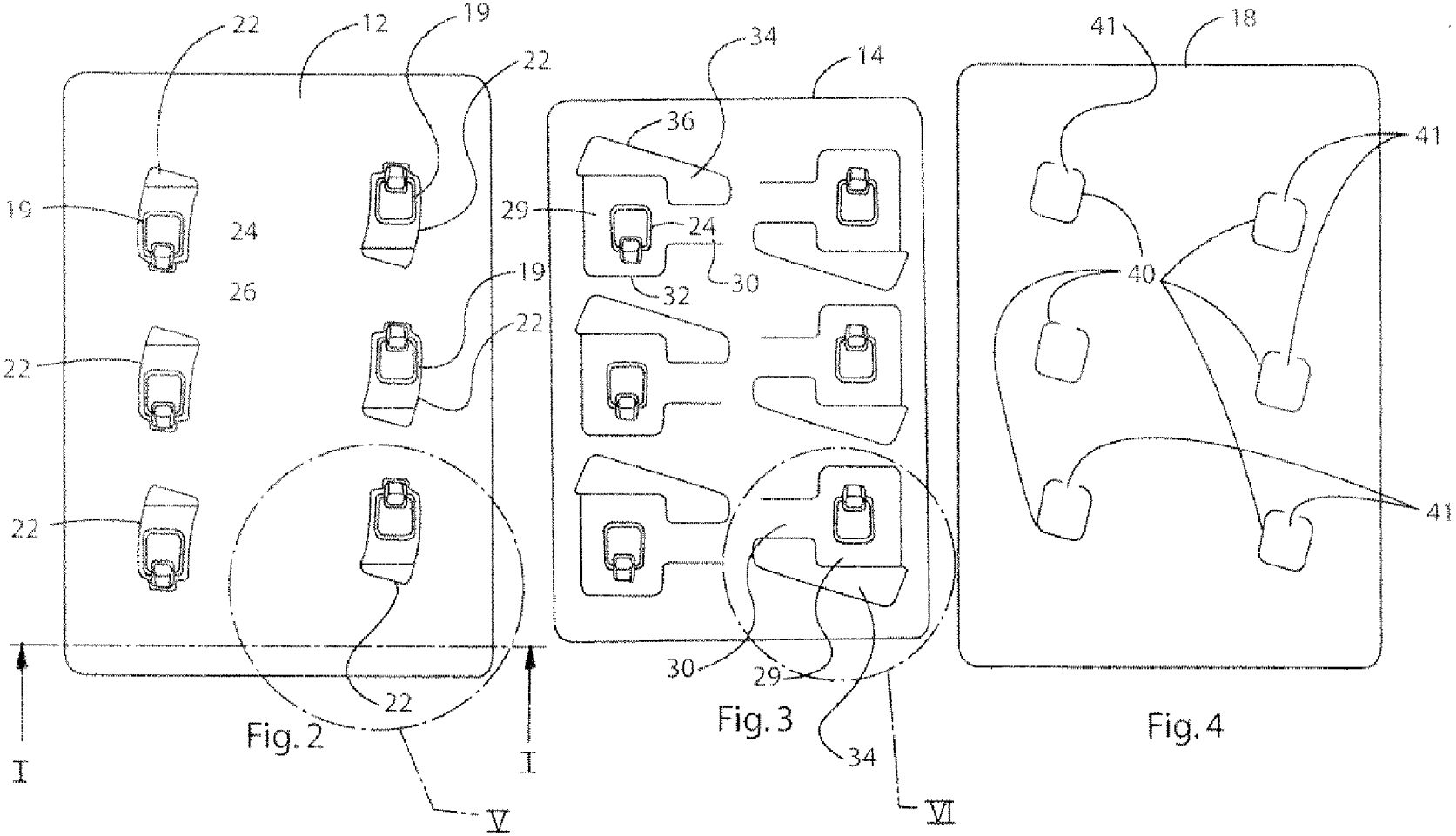
FIG. 2 is a plan view of the blister packaging of the present invention taken generally along line II-II in FIG. 1.
FIG. 3 is a plan view of the blister packaging of the present invention taken generally along line III-III in FIG. 1.
FIG. 4 is a plan view of the blister packaging of the present invention taken generally along line IV-IV in FIG. 1.
Figure 5:
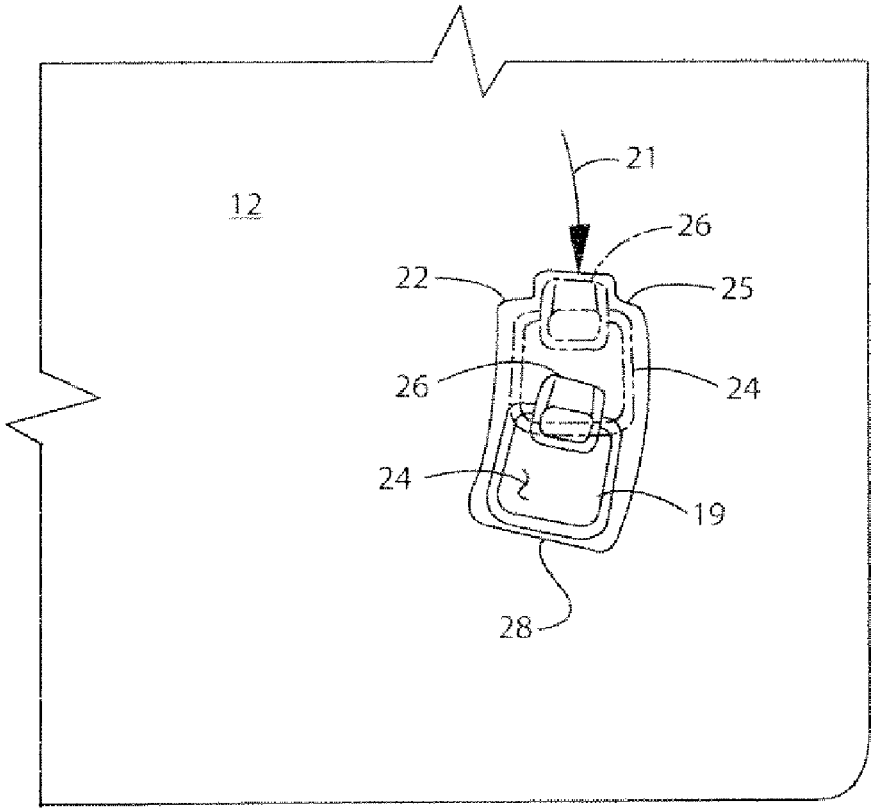
FIG. 5 is an enlarged fragmentary view of the blister packaging of the present invention taken generally of detail V in FIG. 2.

Referring now to FIG. 2, there is illustrated a plan view of the child resistant blister packaging 10 demonstrating a plurality of pill-receiving cavities 24 and apertures 22. Conventionally blister packaging will include a plurality of cavities for storing medicaments and the present invention is not limited to a particular number of cavities. The present invention can accommodate any number of medicaments by including multiple rows or columns of cavities in the blister packaging. In reference to FIGS. 4 and 5, the aperture 22 is slightly wider than the width of a blister 19 containing a pill-receiving cavity 24 and preferably has an arcuate shape as shown in FIG. 5 to guide the blister 19 that houses the pill-receiving cavity 24 along an arcuate path when a thumb or finger of a user is pressed against the lip 26 in the direction of the arrow 21 shown in FIG. 5. The blister 19 containing the pill-receiving cavity 24 will remain at a first end 25 of the aperture 22, demonstrated with phantom lines, and will move to a second end 28 of the aperture 22 when a user applies a sufficient force to the lip 26, in the direction of the arrow 21. The backing card 18 has at least one scored exit port 40 hingedly connected at 41 to the backing card 18 that is in registry with the blister 19 when it is in the full line position for the blister shown in FIG. 5. The scored exit port 40 is thus only in registry with the blister 19 containing the pill-receiving cavity 24 when a user moves the pill-receiving cavity 24 to the second end 28 of the aperture 22, as shown in FIG. 5.

Figure 6:
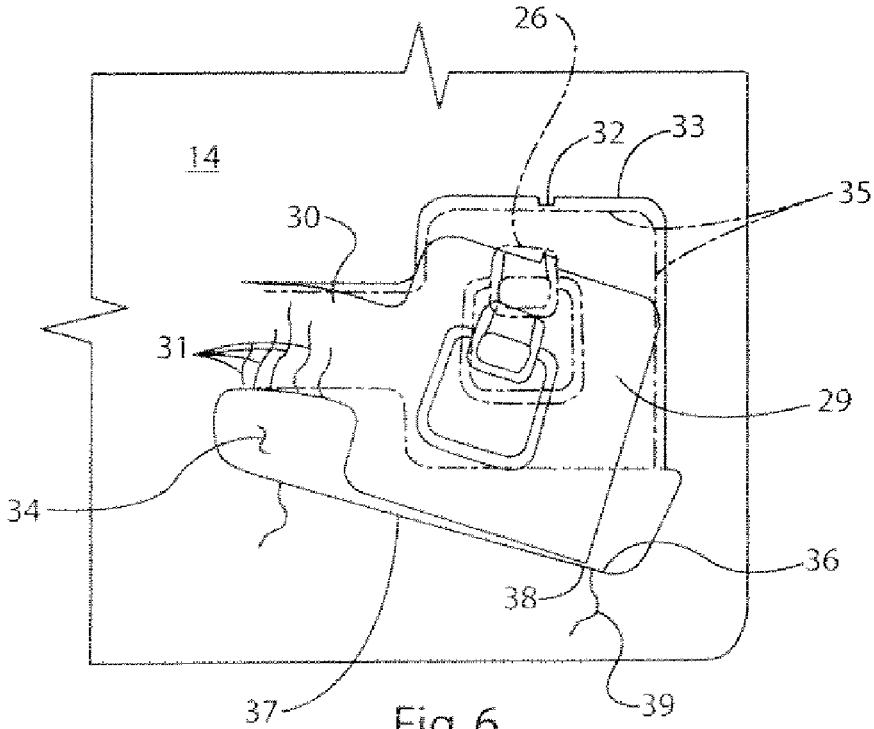
FIG. 6 is an enlarged fragmentary view of the blister packaging of the present invention taken generally of detail VI in FIG. 3.

Referring now to FIGS. 3 and 6, a carrier tab 29, a deformation neck 30, and a deformation gap 34 are shaped into the blister laminate 14 by punching the shapes using a typical process, such as die-cutting. The blister laminate is punched prior to inserting the blister laminate 14 between the cover sheet 12 and the backing card 18. The area of the carrier tab 29 can be of any shape, but preferably the area is generally square and the blister 19 containing the pill-receiving cavity 24 is located approximately in the center of the carrier tab 29. The carrier tab 29 is integrally connected to a deformation neck 30. While in an initial position, demonstrated by phantom lines 35 in FIG. 6, the carrier tab 29 is held in place by a connection means 32. The connection means 32 should be selected such that the blister 19 containing the pill-receiving cavity 24 will resist moving until a user applies a sufficient amount of force to the lip 26 to break the connection means 32 thereby disengaging the carrier tab 29 from the rest of the blister laminate 14. The preferred connection means 32 is a single short, thin strip of the blister laminate 14 along edge 33 that is not cut during the punching process. Applying enough force to the lip 26 to tear the short, thin strip 32 of blister laminate should be difficult to accomplish for a young child, but easy for an adult. The resistance generated by the connection means 32 can be easily modified to be more or less difficult by varying the number or type of connections means. For example, multiple short, thin strips of blister laminate along the edge 33 can be formed during the punching process or a combination of a short, thin strip of blister laminate with a weak adhesive can be applied along edge 33. Upon tearing the connection means 32, a user must slide the blister 19 containing the pill-receiving cavity 24 across the deformation gap 34 which stops when the corner 38 of the carrier tab 29 engages a ridge 36. The gap 34 in the blister laminate 14 is formed such that its periphery runs at an angle as shown at 37 in FIG. 6. An optional elevated rib 39 runs parallel and adjacent to the ridge 36 further facilitating the stop when the corner 38 engages the ridge 36. Referring to FIG. 5, the end 28 of the aperture 22 also serves as a stop when the blister 19 containing the pill-receiving cavity 24 is pressed against the end 28 of the aperture 22. When sliding blister 19 containing the pill-receiving cavity 24, the deformation neck 30 is bent and stressed as indicated by stress lines 31; however, the deformation neck 30 is resilient, providing a spring-like resistance to movement of the blister in the longitudinal direction of arrow 21. The resilience in the deformation neck 30 provides an additional child resistant feature of the present invention. In order to align pill-receiving cavity 24 in registry with the scored exit port 40, a substantially constant force must be applied to the lip 26 to keep the blister 19 containing the pill-receiving cavity 24 in the full line position therefore shown in FIG. 6.

Figure 7:
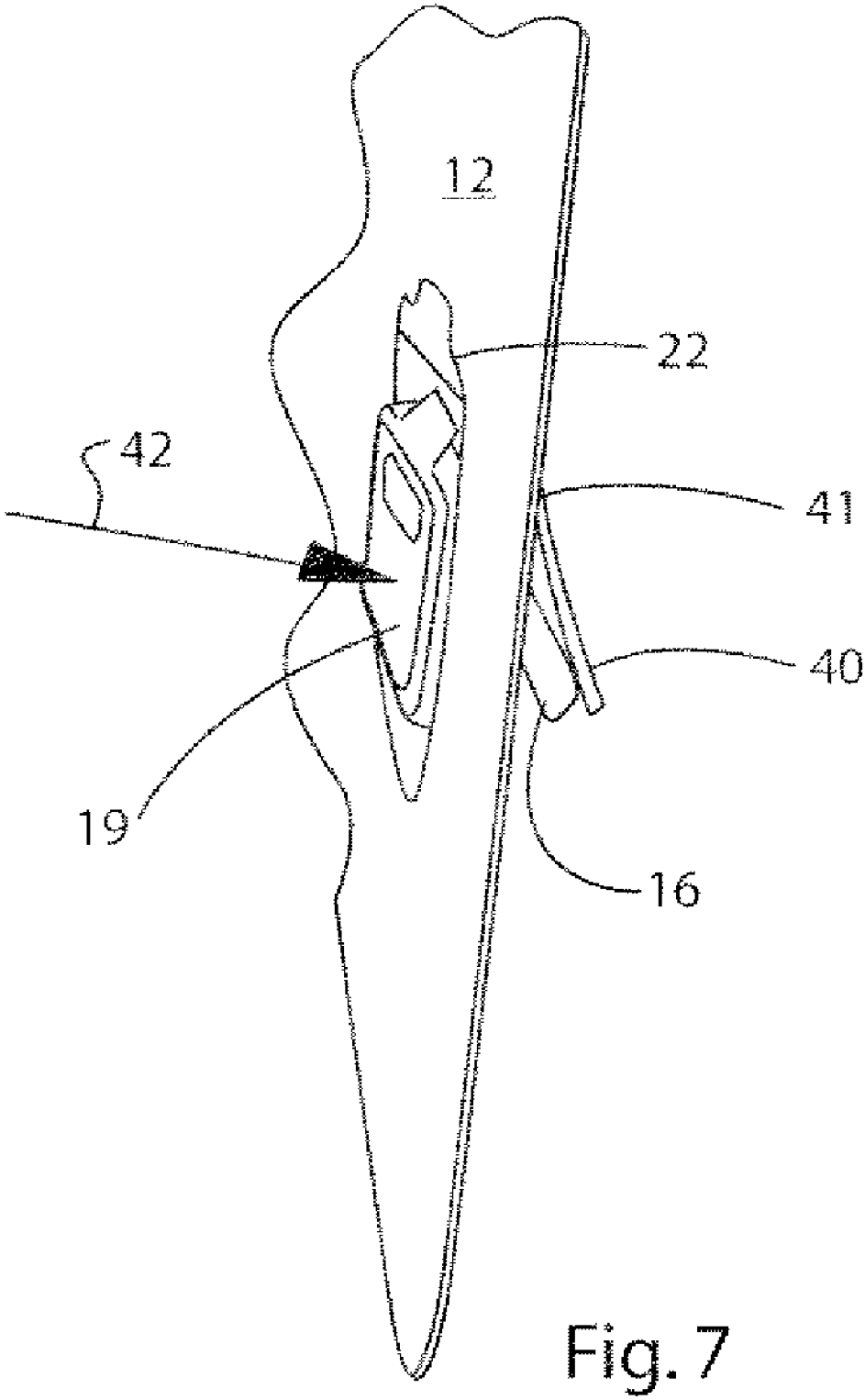
FIG. 7 is an enlarged fragmentary perspective view of the blister packaging of the present invention showing a collapsed pill-receiving cavity, a ruptured foil layer, and a ruptured scored exit port.

Referring to FIG. 7, once the blister 19 containing the pill-receiving cavity 24 is in the final position as shown in full lines in FIG. 6, a user can remove a medicament stored in the pill-receiving cavity 24 upon engaging the blister 19 with a thumb or finger and applying a force in the transverse direction 42, forcing the medicament through the rupturable layer 16 and out through the scored exit port 40.

From the foregoing it is seen that, the present invention provides a package construction requiring exercise of a predetermined opening procedure to effectively bar access to children, and which otherwise fully accomplishes its intended objects.

While preferred embodiments of the invention have been disclosed and described in detail, it is to be understood that the invention is not so limited, but rather it is intended to include all embodiments which would be apparent to one skilled in the art and which come within the spirit and scope of the invention.

What is claimed is:

1. A child-resistant blister packaging comprising:

a cover sheet having at least one aperture, said aperture having a first end and a second end, a backing card having at least one exit port, and a blister laminate arranged between said cover sheet and said backing card, wherein said exit port is in registry with said second end of said aperture, said blister laminate comprising a blister sheet and a rupturable layer, wherein said blister sheet has a top surface and a bottom surface, said top surface having at least one blister containing a pill-receiving cavity integrally formed therein and projecting from said top surface and through said first end of said aperture, and wherein said rupturable layer is laminated onto said bottom surface of said blister sheet, said rupturable layer extending over and sealingly closing said pill-receiving cavity, said blister laminate further comprising at least one carrier tab, at least one separable connection means, and at least one deformation gap adjacent to said carrier tab, said carrier tab being integrally connected to a deformation neck and said carrier tab having a perimeter wherein said blister resides within said perimeter, wherein said carrier tab is held stationary by said at least one separable connection means and said blister is not in registry with said exit port, and upon severing said at least one separable connection means, said carrier tab and blister is movable and said blister is guided by said aperture and said deformation neck from said first end of said aperture to said second end of said aperture to align in registry with said exit port.

2. The child-resistant blister packaging of claim 1, wherein the child resistant blister packaging has a plurality of blisters, a plurality of apertures, and a plurality of exit ports.

3. The child-resistant blister packaging of claim 1, further comprising a ridge along a periphery of said deformation gap, wherein said aperture is in alignment with said exit port when said carrier tab engages said ridge of said deformation gap.

4. The child-resistant blister packaging of claim 3, wherein an elevated rib runs parallel and adjacent to said ridge of said deformation gap.

5. The child-resistant blister packaging of claim 1, wherein said cover sheet and said backing card are made of substantially rigid materials.

6. The child-resistant blister packaging of claim 1, wherein said blister has a lateral protrusion to accommodate the tip of a finger or thumb.

7. The child-resistant blister packaging of claim 1, wherein said aperture has an arcuate shape.

8. The child-resistant blister packaging of claim 1, wherein said aperture and said deformation neck comprise means for guiding movement of said blister from said first end of said aperture to said second end of said aperture along an arcuate path.

9. The child-resistant blister packaging of claim 1, wherein said exit port is a scored area in said backing card.

10. The child-resistant blister packaging of claim 1, wherein said carrier tab and said exit port are generally square shaped.

11. The child-resistant blister packaging of claim 1, wherein said blister is approximately centered on said carrier tab.

12. The child-resistant blister packaging of claim 1, wherein said deformation neck is made of a resilient material and comprises means for providing resistance to movement of said blister from said first end of said aperture to said second end of said aperture.

13. The child-resistant blister packaging of claim 1, wherein said connection means is integrally connected to said carrier tab and said blister laminate.

14. The child-resistant blister packaging of claim 1, wherein said connection means is at least one short, thin strip of said blister laminate.

15. A method of extracting a medicament from a pill-receiving cavity in the child resistant blister packaging of claim 1 comprising the steps of:

exerting pressure on a side wall of the at least one buster containing said pill-receiving cavity protruding through the first end of said aperture in the cover sheet, wherein the pill-receiving cavity is arranged on said carrier tab that is connected to said at least one separable connection means, separating said separable connection means so that said carrier tab is movable, guiding said blister to the second end of said aperture by deforming said deformation neck integrality connected to said carrier tab until said carrier tab is at the second end of the aperture, aligning said pill-receiving cavity with said exit port in said backing card of the child resistant blister packaging, and collapsing a top surface of the blister to push the medicament stored in said pill-receiving cavity through said rupturable layer and said exit port.

16. The method of claim 15, including the step of providing resistance to movement of said blister from said first end of said aperture to said second end of said aperture.

* * * * *

UNITED STATES PATENT AND TRADEMARK OFFICE

CERTIFICATE OF CORRECTION

PATENT NO. : 7,690,511 B2
APPLICATION NO. : 11/856824
DATED : April 6, 2010
INVENTOR(S) : William S. Arnold et al.

It is certified that error appears in the above-identified patent and that said Letters Patent is hereby corrected as shown below:

Column 6 Line 39 change --buster-- to --blister--

Signed and Sealed this

Twenty-fifth Day of May, 2010

David J. Kappos

David J. Kappos
*Director of the United States Patent and Trademark Office*